United States Patent [19]

Wittern et al.

[11] 3,986,637

[45] Oct. 19, 1976

[54] VENDING APPARATUS

[75] Inventors: Francis A. Wittern, Des Moines; Arthur N. Wirstlin, Altoona, both of Iowa

[73] Assignee: Fawn Engineering Co., Des Moines, Iowa

[22] Filed: May 12, 1975

[21] Appl. No.: 576,246

[52] U.S. Cl. ..... 221/75

[51] Int. Cl.[2] ..... G07F 11/36

[58] Field of Search ..... 221/75

[56] References Cited

UNITED STATES PATENTS

| | | | |
|---|---|---|---|
| 3,269,595 | 8/1966 | Krakauer et al. | 221/75 |
| 3,344,953 | 10/1967 | Krakauer et al. | 221/75 |
| 3,828,971 | 8/1974 | Offutt et al. | 221/75 |
| 3,840,147 | 10/1974 | O'Neal et al. | 221/75 |
| 3,861,561 | 1/1975 | Wittern et al. | 221/75 |

*Primary Examiner*—Robert B. Reeves
*Assistant Examiner*—Charles A. Marmor
*Attorney, Agent, or Firm*—Henderson, Strom & Sturm

[57] ABSTRACT

A vending apparatus of the type having a helical member rotatably disposed in a vending chamber. A vertical divider is disposed within the helical member for positioning items to be vended in two rows. A mechanism is also provided for compressing the helical member and releasing such compressed helical member by rotation of such helical member to thereby aid in the discharge of items placed on one side of the vertical divider. Rotation of the helical member by one-half of a revolution releases an item on one side of the vertical divider. Further rotation of one half of a revolution releases an item from the other side of the vertical divider, and so forth, releasing an item from the front of each side successively.

9 Claims, 5 Drawing Figures

VENDING APPARATUS

BACKGROUND OF THE INVENTION

The present invention relates generally to a vending apparatus and more particularly to a vending apparatus of a type which utilizes a rotating helical member.

In vending machines of a type utilizing a helical member disposed in the vending chamber, items to be vended are placed between the convolutions of helical member and upon a predetermined rotation of the helical member, these items are advanced forwardly with the most forward of the items being discharged and dispensed during such rotation. One of the most critical problems in this type of vending apparatus is obtaining a positive discharge of a single item when desired. U.S. Pat. Nos. 3,826,971 and 3,861,561 for example, have solved this particular problem to one degree or another.

In U.S. Pat. No. 3,861,561 the turned down lip on one side of an adjustable floor has proven to be a very effective discharging aid. It is impractical, however, to turn down the other forward discharge side of the floor in such device because that would detract from the adjustable feature thereof. Accordingly, a discharge aiding feature for the other forward discharge side of floor as shown in this patent would be very useful.

Another problem associated with helix-type vending machines is the one of how to rotate the helix itself without producing excessive wobbling or flexing. This problem is only complicated when utilizing a divider disposed within the helix for allowing two rows of items to be vended in each helix.

SUMMARY OF THE INVENTION

The present invention relates to a vending apparatus having a housing with item vending chambers disposed therein. A helical member is disposed in each of the item vending chambers and means are provided for selectively rotating these helical members. A mechanism is also provided for selectively compressing the helix during its rotation and releasing the compressed helix when desired, in order to eject and thereby positively dispense an item to be vended therefrom. Additionally, a novel helix mounting structure for rotating and stabilizing the helix is provided.

An object of the present invention is to provide for a positive discharge of an item being vended in a helix-type vending machine.

Another object of the invention is to provide a mounting for a helix-type vending machine which prevents the helix from excessively wobbling or flexing.

A further object of the present invention is to provide a helix-type of vending apparatus which is simple and easy to fabricate and economical to produce, while at the same time being extremely dependable.

Other objects, advantages, and novel features of the present invention will become apparent from the following detailed description of the invention when considered in conjunction with the accompanying drawings.

DESCRIPTION OF THE PREFERRED EMBODIMENT

Figure 1:
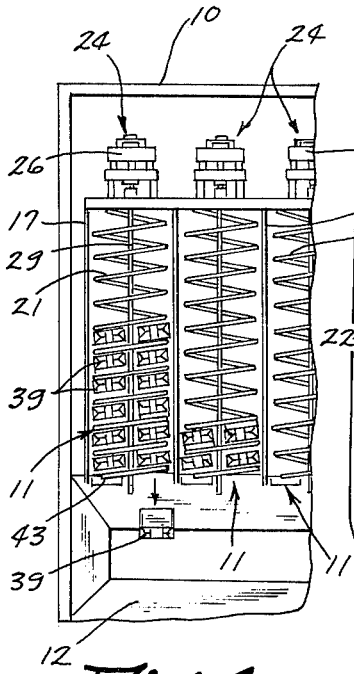
FIG. 1 is a top view of a vending machine constructed according to the present invention but with the top cover removed.

Referring now to the drawings wherein like reference numerals designate identical or corresponding parts throughout the several views, FIG. 1 shows a housing 10 having the lid thereof removed. A plurality of vending units 11 are disposed in side by side relationship as shown in FIG. 1. A chute is located in front of and below the front portions of the vending units 11.

Figure 4:
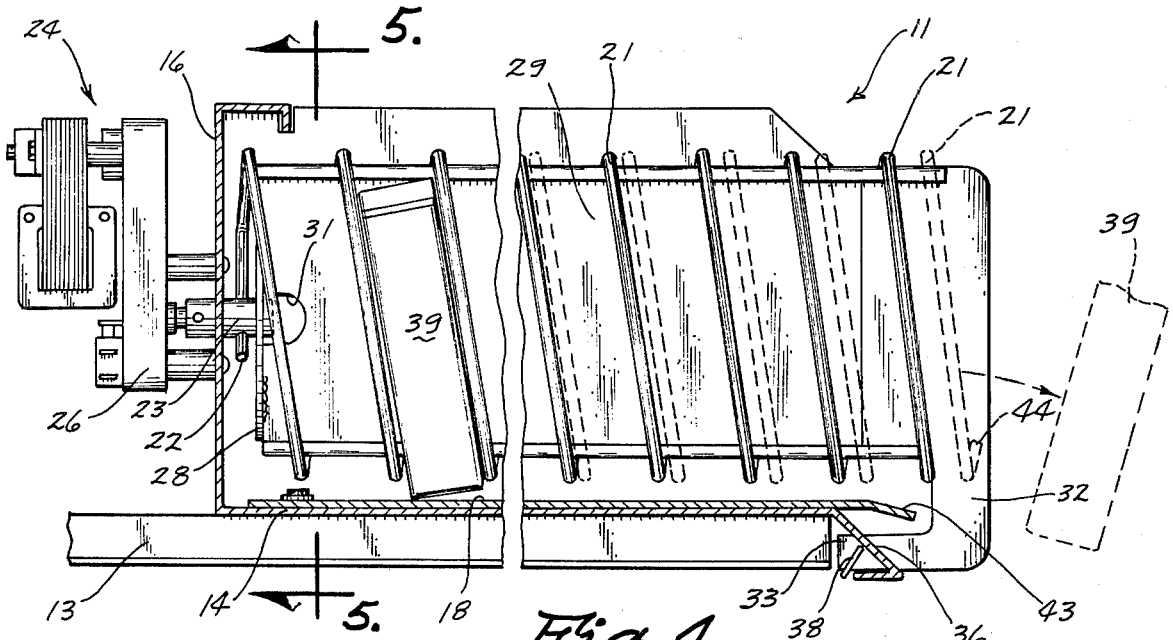
FIG. 4 is a side cross-sectional view taken along line 4—4 of FIG. 3.
Figure 5:
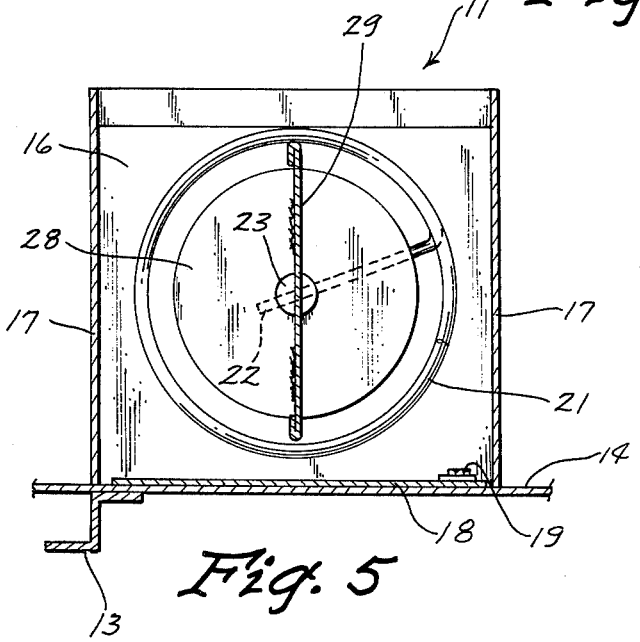
FIG. 5 is a cross-sectional view taken along line 5—5 of FIG. 4.

Each of these vending units 11 are connected to the housing 10 by a plurality of brackets 13 (FIGS. 4 and 5). A floor 14 rests on the brackets 13 and has an upstanding end wall 16 attached at the rear end thereof. Side walls 17 are disposed on each side of each of the vending devices 11.

A subfloor 18 is attached to the floor 14 by a fastening device 19. The importance of this subfloor is to be able to adjust the position of the effective front end of the floor such that various sizes of packages to be vended can be used without replacing the helical member 21 by one of a different size. This feature does not, however, form a part of this invention but is fully discussed in U.S. Pat. No. 3,861,561.

A helical member 21 is disposed within a vending chamber formed by the floor 14, the end wall 16 and the side walls 17. One end 22 of the helix 21 is substantially straight and passes through an opening in a drive shaft 23. This shaft 23 is driven or rotated by an electric motor 24 through a drive train or gearing structure 26. It is to be understood, however, that the motor 24 can directly drive the shaft 23 and that other means for rotating the shaft 23 are fully equivalent to the electric motor 24.

The shaft 23 extends through a complimentarily shaped opening 27 in a plate 28 such that the shaft 23 may rotate within the opening 27. The plate 28 is secured to a vertical divider 29 (FIG. 2) such as by welding. A cutout portion 31 in the vertical divider 29 facilitates the reception of the shaft 23 within the opening 27.

Figure 2:
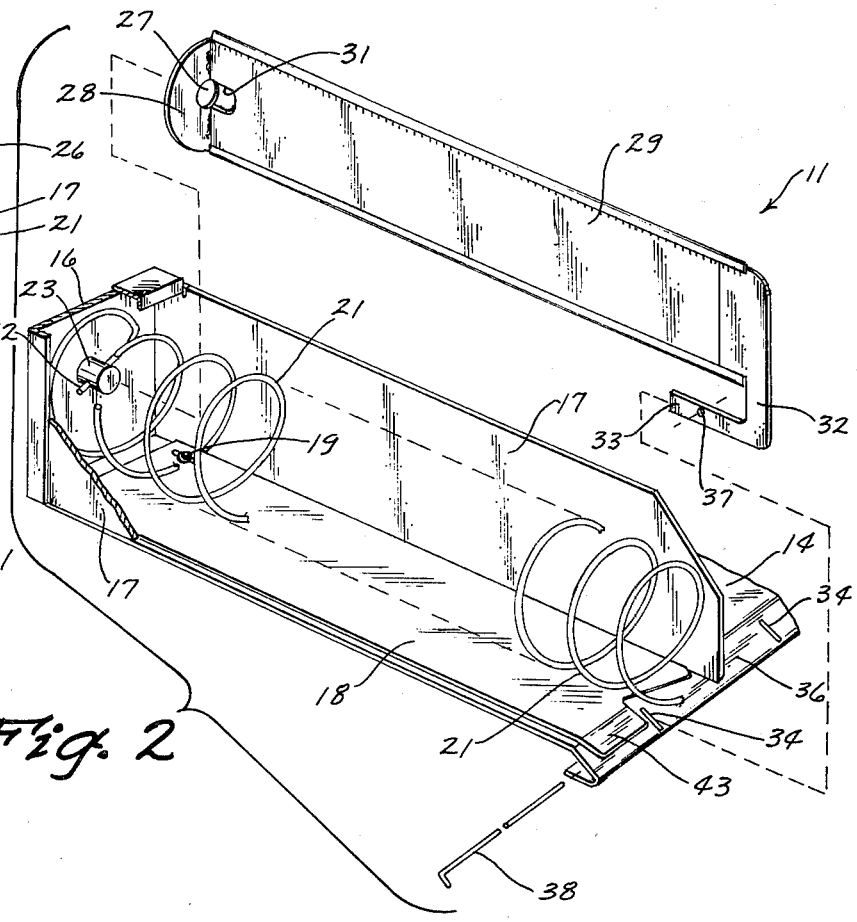
FIG. 2 is an exploded perspective view of one of the vending units of the present invention.

The other end of the vertical divider 29 has a projection member 32 attached thereto. This projection member 32 includes a portion 33 which extends through a slot 34 (FIGS. 2 and 4). A slot 34 is formed in front of each of the vending devices 11 in a turned down lip 36 of the floor 14. A hole 37 is formed in the portion 33 of the projecting member 32 for reception of a locking rod 38 which passes through hole 37 in each of the vertical dividers 29 in each horizontal row of vending devices 11. It can therefore be appreciated that the vertical divider 29 is secured to the floor by the rod 38 and the portion 33 of the projecting member 32 at one end thereof, and is held at the other end thereof by the action of the shaft 23 which supports the other end of the vertical divider 29 in the opening 27 of the plate 29.

In operation, items 39, such as packages of cigarettes, are placed between the convolutions of the helical member 21 in two rows on each side of the vertical divider 29. When the helical member 21 is rotated by one-half of a revolution, the front package on one side of the vertical divider 29 will advance forwardly to the point where it is not held by a convolution of the helical member 21 and such that it will drop off of the subfloor 18, down the chute 12, and to the consumer. The next time a consumer operates this same vending device 11, the action of the coins placed into the vending machine will actuate the motor to thereby turn the helical member 21 again by one-half of a revolution and thereby dispense the forward most item on the other side of the vertical divider 29. This operation will continue for each successive use of the vending device 11 such that the forward most item 39 in the vending device 11 will be dispensed after each one-half of a revolution of the helical member 21, as is fully disclosed in U.S. Pat. No. 3,861,561. Coins are used to activate the motor 24 and a mechanism (not shown) is provided to shut the motor off after the helical member has been rotated by one-half of a revolution. Such structure is well known in the art and is shown for example in co-pending patent application Ser. No. 572061 filed Apr. 28, 1975.

It has been found that while the turned down lip 43 on the subfloor 18 serves to assist the package on that side of the vertical divider 29 to positively eject and be dispensed, that the other side of the subfloor 18 does not eject in as positive a manner. If a turned down lip were to be used on such other side of the subfloor 18, then the subfloor structure could not be as versatile and adjustable as desired. Consequently, the projection 32 is utilized in combination with the forward most convolution of the helical member 21 to compress the helical member 29 and then allow the helical member 29 to release and "kick" or push the item 39 forwardly as show in FIGS. 3 and 4, by the force of the releasing of the compression on the helical member 21.

Figure 3:
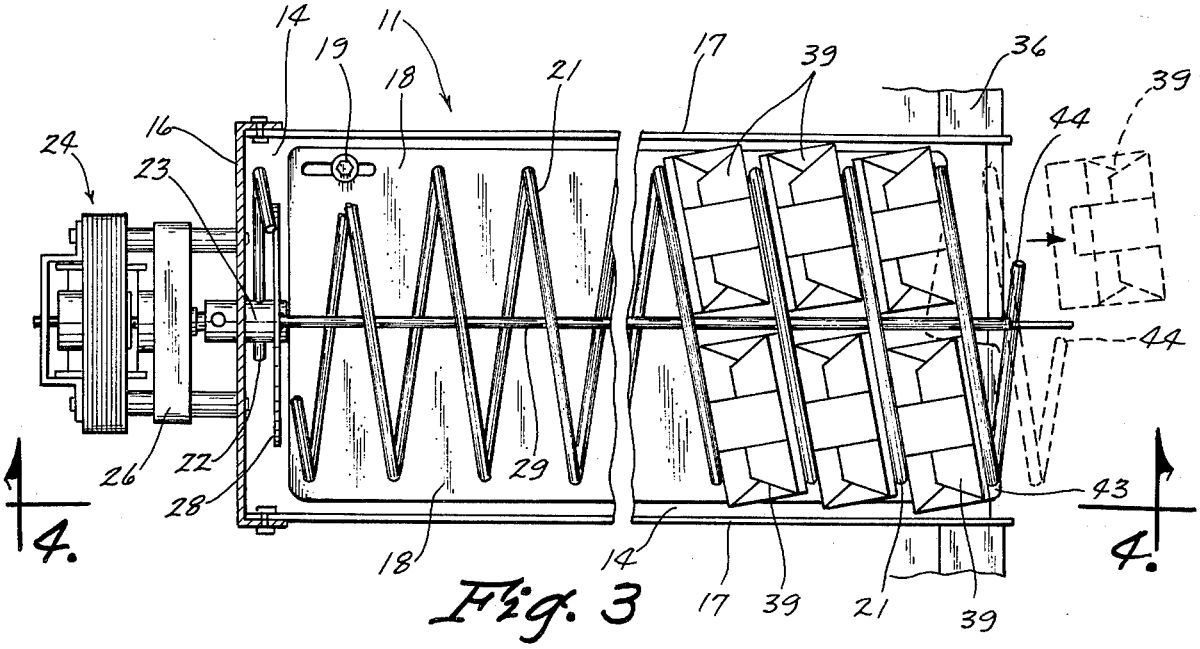
FIG. 3 is an enlarged top view of one of the vending units of the present invention.

Referring to FIG. 3 it can be seen that when the helical member 21 is in a position shown in solid lines that a portion of the front end 44 of the helical member 21 extends under the vertical divider 29 and against the projecting member 32. As the helical member 21 rotates in a clockwise direction as shown in FIG. 5, for example, the helical member 21 is compressed because of this abutment with the projecting member 32. Once the end 44 of the helical member 21 passes beyond the projecting member 32 to the other side of the divider 29, the projecting member 32 will no longer be in abutment with the helical member 21 and therefore the helix will expand at least to its normal position, as shown in dashed lines in FIGS. 3 and 4. When the helical member 21 expands and jumps forwardly because the pressure from the projecting member 32 has been released, the helical member 21 will very quickly push the item 39 shown in dashed lines in FIGS. 3 and 4 forward and down the chute 12 for a very positive discharge thereof.

Accordingly, it has been shown that the present invention does indeed accomplish the objects referred to above. Obviously, many modifications and variations of the present invention are possible in light of the above teachings. It is therefore to be understood, that within the scope of the appended claims, the invention may be practiced otherwise than as specifically described.

We claim:

1. A vending apparatus comprising:

a housing;

means connected to said housing for forming an item vending chamber, said chamber having a floor;

a discharge chute disposed at one end of said floor and said chamber;

a substantially helical member disposed about a longitudinal axis within said chamber;

means mounted to the housing and connected to one end of the helical member for selectively rotating said helical member about its longitudinal axis; and means operably connected to said housing for selectively compressing said helical member along said longitudinal axis and releasing the compression on said helical member during a predetermined amount of rotation of said helical member to thereby aid in the discharge of items being vended by pushing said items towards said discharge chute.

2. A vending apparatus as defined in claim 1 wherein the connection of the helical member to the rotating means includes a rotatable shaft having an opening therein, and a portion of the one end of said helical member extending into said opening.

3. A vending apparatus as defined in claim 1 wherein said means for selectively compressing and releasing the compression on the helical member comprises a projecting member connected to said chamber forming means, said projecting member extending into said chamber adjacent the other end of said helical member, for intermittent contact with said other end of the helical member upon sufficient rotation of the helical member.

4. A vending apparatus as defined in claim 3 wherein said projecting member is disposed adjacent a front and central portion of the floor of said chamber.

5. A vending apparatus as defined in claim 3 including a divider disposed within said helical member, said helical member being rotatable with respect to said divider.

6. A vending apparatus as defined in claim 5 wherein said divider is vertically oriented.

7. A vending apparatus as defined in claim 6 wherein a plate is affixed to one end of the vertical divider, said plate being transverse with respect to the vertical divider and having an opening therein;

the connection of the helical member to the rotating means including a shaft, said shaft being journaled in said opening.

8. A vending apparatus as defined in claim 7 wherein the other end of said vertical divider is connected to said projecting member.

9. A vending apparatus as defined in claim 8 wherein the connection of said projection means to said chamber forming means comprises:

a slot formed in said chamber forming means, a portion of said projecting means extending through said slot, a hole formed in said portion of the projecting means and a rod being selectively receivable into said hole.

* * * * *